US006454260B1

(12) United States Patent
Noolandi et al.

(10) Patent No.: US 6,454,260 B1
(45) Date of Patent: Sep. 24, 2002

(54) AIR JET BOARD DEVICE

(75) Inventors: Jaan Noolandi, Mississauga (CA); David K. Biegelsen, Portola valley, CA (US); Patrick C. P. Cheung, Castro Valley, CA (US); Andrew A. Berlin, San Jose, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/730,159

(22) Filed: Dec. 5, 2000

(51) Int. Cl.[7] ..... A63F 7/36; A63F 7/07

(52) U.S. Cl. ..... 273/108; 273/126 A; 273/129 AP

(58) Field of Search ..... 273/126 R, 126 A, 273/119 B, 129 AP, 108, 118 A, 119 A

(56) References Cited

U.S. PATENT DOCUMENTS 3,773,325 A * 11/1973 Crossman et al. ..... 273/126 A
3,871,585 A * 3/1975 Crossman et al. ..... 239/553.3
3,887,187 A * 6/1975 Crossman et al. ..... 273/126 A
3,954,267 A * 5/1976 Freeman et al. ..... 273/126 A
5,356,143 A * 10/1994 Hylak ..... 273/126 A
5,634,636 A * 6/1997 Jackson et al. ..... 271/184
5,839,722 A * 11/1998 Berlin et al. ..... 269/309
6,004,395 A 12/1999 Yim et al.
6,105,960 A * 8/2000 Carames ..... 273/108.1
6,109,607 A * 8/2000 Cartwright et al. ..... 273/108.1
6,234,476 B1 * 5/2001 Yamashita et al. ..... 273/126 A
6,276,682 B1 * 8/2001 Yamashita et al. ..... 273/126 A

* cited by examiner

*Primary Examiner*—Raleigh W. Chiu
(74) *Attorney, Agent, or Firm*—Perman & Green, LLP

(57) ABSTRACT

An air jet game comprising an air jet conduiting member having a plurality of air jet outlets and a controller adapted to selectively control at least partially, the flow of air out of the air jet outlets in order to move an object located in an air flow path of the outlet in a desired direction.

25 Claims, 10 Drawing Sheets

FIG. 3
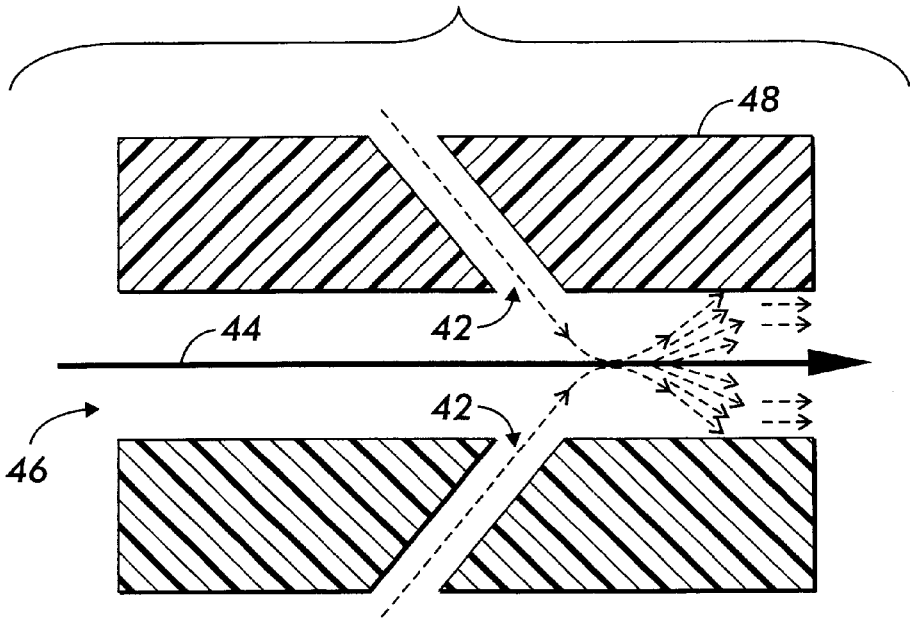
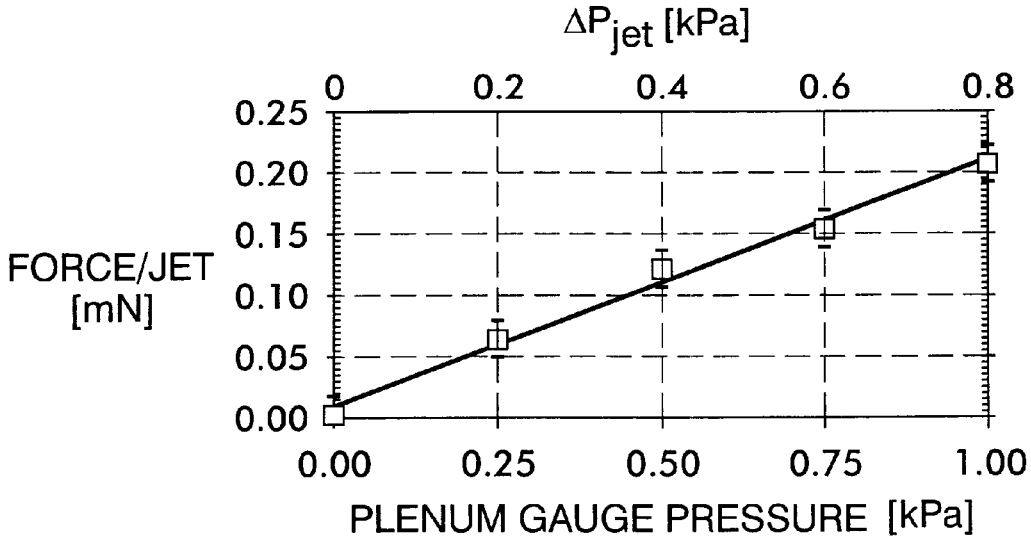
FIG. 4

AIR JET BOARD DEVICE

BACKGROUND OF THE INVENTION

1. Field of the Invention

The present invention relates to airjet object movement systems, and more particularly, to an airjet board game.

2. Prior Art

Systems for supporting objects with a controlled fluid flow are known. For example, U.S. Pat. No. 6,004,395, which is commonly owned by Applicants'assignee and the disclosure of which is incorporated herein by reference, discloses a valve array for supporting objects, such as paper, with controlled fluid flow.

SUMMARY OF THE INVENTION

The present invention is directed to, in a first aspect, an air jet game. In one embodiment, the air jet game comprises an air jet conduiting member having a plurality of air jet outlets and a controller adapted to selectively control at least partially, the flow of air out of the air jet outlets in order to move at least one object located in an air flow path of the outlet in a desired direction.

In another aspect, the present invention is directed to a method of controlling the movement of an object in an air jet board game. In one embodiment, the method comprises detecting a position of the object, and moving the object in a desired direction by one or more air jets in the board. The step of moving comprises each air jet being selectively energized based upon the detected position of the object and a respective control input corresponding to the desired direction and desired velocity of the object. Points are scored in the game by moving the object past a goal area on the board.

In a further aspect, the present invention is directed to an air jet object mover game. In one embodiment, the air jet object mover comprises an array of air jets, an array of object sensors, and a first controller and a second coupled to the array of air jets and the array of object sensors. Each controller is adapted to selectively control the movement of the object over the array of air jets by selectively activating one or more of the air jets based upon on a detected position of the object by the object sensors and a desired direction of movement of the object.

BRIEF DESCRIPTION OF THE DRAWINGS

The foregoing aspects and other features of the present invention are explained in the following description, taken in connection with the accompanying drawings, wherein:

FIG. 3 is a cross-sectional view of a pair of airjets levitating and accelerating an object in one embodiment of a system incorporating features of the present invention.

FIG. 4 is a graphical representation of the measured lateral force per jet versus pressure drop across a jet and plenum pressure for one embodiment of a system incorporating features of the present invention.

DETAILED DESCRIPTION OF THE PREFERRED EMBODIMENT

Figure 1:
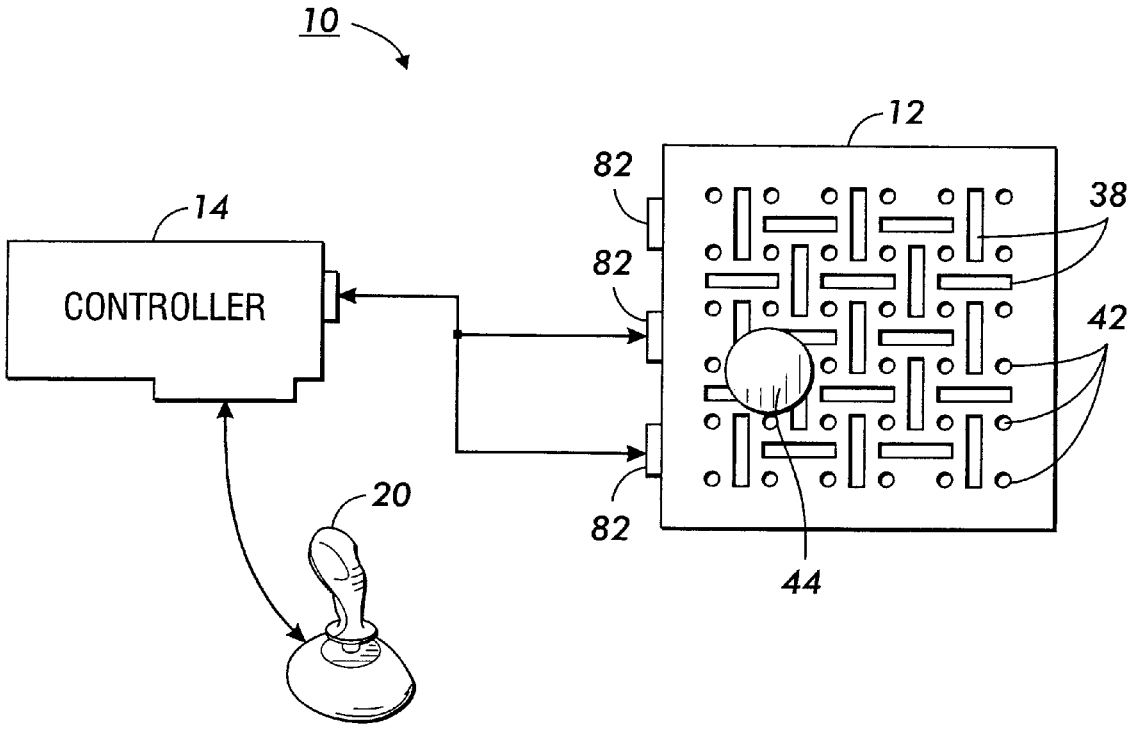
FIG. 1 is a block diagram of one embodiment of an airjet board game incorporating features of the present invention.

Referring to FIG. 1, a block diagram of a game 10 incorporating features of the present invention is shown. Although the present invention will be described with reference to the embodiments shown in the drawings, it should be understood that the present invention can be embodied in many alternate forms of embodiments. In addition, any suitable size, shape or type of elements or materials could be used.

Generally, the system or game 10 comprises an air jet conduiting member 12, also referred to as an airjet board, and a movable object 44. The game may also include a controller 14 that is adapted to allow a user to control the position and movement of the object 44 on the board. The game 10 may also include one or more positioning control devices 20. In one embodiment, the positioning control device 20 can comprise a joystick. A user can use the joystick 20 to control the position and movement of a movable object 44 on the board 12. It is a feature of the present invention to allow one or more users to control the movement of one or more objects 44 over the board 12 in a game. A game can involve controlling the flow of air along a surface of the board 12 in order to move the object over the board 12. In one embodiment, the object 44 could be levitated over the board 12. For example, a game may comprise a user playing against another user or a computer as an opponent, and attempting to control the movement of one or more objects 44 on the board 12.

In one embodiment, the airjet board 12 comprises a plurality of airjets 42 and sensors 38. The member 12 may also include one or more connectors 82 for coupling the member 12 to the controller 14, coupling the member 12 to another member 12, or for coupling the member 12 to other suitable devices. In one embodiment, the game 10 also includes the positioning control device 20 that is adapted to control the movement of the object 44 along or over the board 12. The positioning control device 20 may be coupled to the controller 14 and can be adapted to provide positioning commands to the controller 14. In one embodiment, the positioning device 20 can be an integral part of the controller 14. In an alternate embodiment, the game 10 can include such other suitable components for controlling the position of an object with an airjet.

Figure 2:
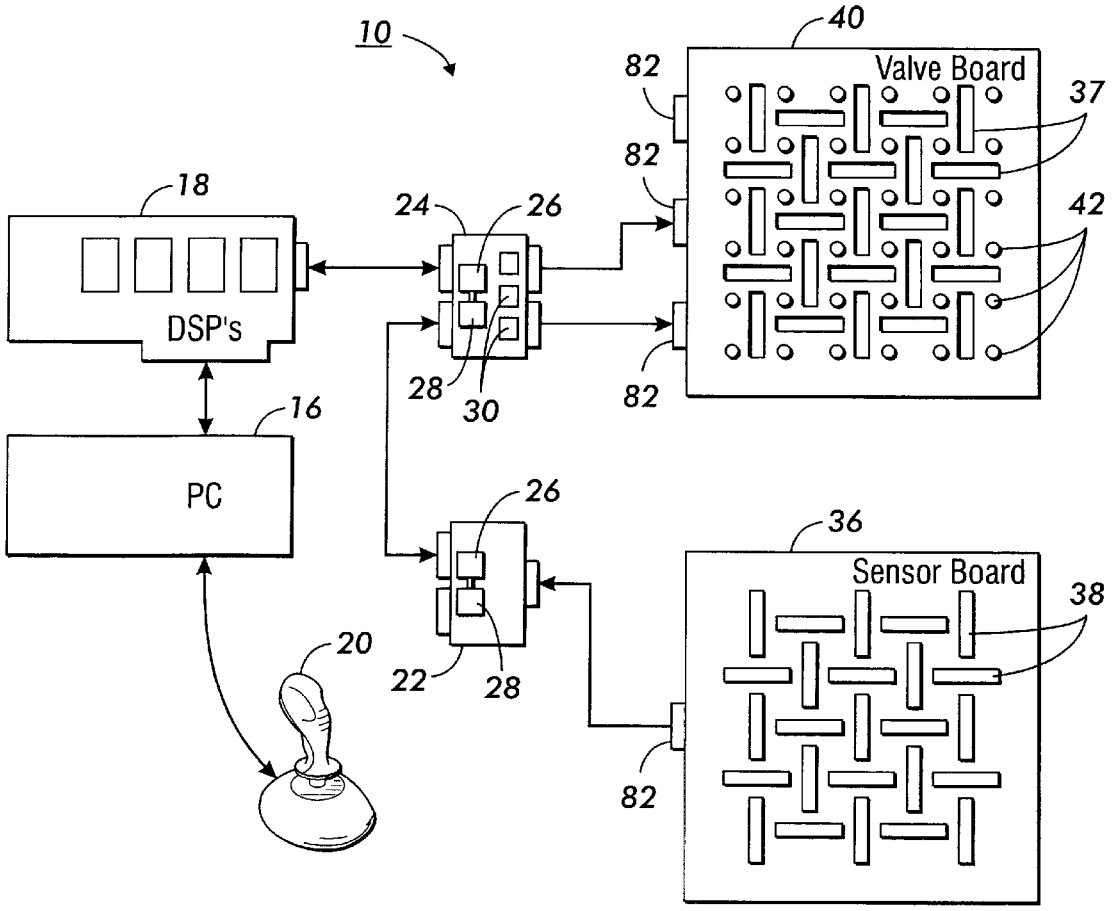
FIG. 2 is a block diagram of one embodiment of an airjet system incorporating features of the present invention.

As shown in FIG. 2, in one embodiment, the air jet conduiting member 12 can comprise a valve board 40 and a sensor board 36. Generally, the valve board 40 comprises an array of airjets 42 and may include a plurality of openings 37 for sensors 38. The sensor board 36 comprises an array of sensors 38. Generally, the airjets 42 can be used to move an object on the board, for example by rolling, and/or levitate the object 44 above the board 12. The sensors 38 detect the position of the object 44 on or over the board 12. In an alternate embodiment, the game 10 may include such other suitable components for moving an object 44 with an air jet system. It is a feature of the present invention to provide a system for moving an object 44 in three degrees of freedom without making physical contact with the object 44. Generally, the object 44 comprises a lightweight flexible medium, such as for example, a sheet of paper or a disk like object that can be levitated over the board 12. The disk can comprise any suitable material, such as for example, plastic. In an alternate embodiment, the object 44 can make contact with the board 12 at a point and be moved along the board 12 by the airjet 42 in a rolling or sliding fashion. For example, the object can comprise a hollow or semi-hollow sphere or disk which rolls on the board and can comprise any suitable material such as for example, plastic.

FIG. 3 is a cross-section of an object 44 being levitated and accelerated by a pair of airjets 42 in an air channel 46, in an exemplary 2-sided embodiment of the present invention. Arrays of simple cylindrical orifices pass through the plates oriented, in one embodiment, at approximately 45 degrees with respect to the plate normal. A small pressure gradient along an orifice passage 42 creates a jet of air as shown in FIG. 3. In an alternate embodiment, any suitable number of airjets in any suitable orientation can be used to move the object 44. It is a feature of the present invention to levitate and move an object 44 at high accelerations and peak velocities. As shown in FIG. 3, three dimensionally confined airjets 42 impinge on the sheet 44 and apply localized shear stress on the sheet 44. Fluid jets directed with a velocity component normal to the surface of the object 44 must have their flow redirected. Conservation of total momentum implies some direct momentum transfer to the object 44 along the channel 46. Another force acting on the object 44 exerts a shear force on the surface of the object 44 due to the viscous momentum exchange in a velocity gradient. The viscous drag slows the fluid, or air, and accelerates the object 44. The boundary layer is the fluid or air region adjacent to the surface of the object in which the velocity transitions from the velocity of the solid bounding surface to nearly the fluid velocity far from the surface. In one embodiment, the boundary layer thickness, approximately 1 mm, is considerably greater than the root mean square height variations characterizing the texture of most paper stocks. Thus, the shear force exerted is approximately independent of the surface texture of the object 44.

The downstream air spreads out laterally and vertically, and produces far less lateral force on the sheet 44. Forces are dominated by those created in the jet impingement zones. Generally, air spreading out in the channel 46 downstream slows and disperses. At the low Reynolds numbers encountered here (Re<1000), flows are laminar. The lateral forces on the sheet 44 are given by the Newtonian law of friction, $F=\mu dv_x/dy$, where $\mu$ is the dynamic viscosity, $V_x$ is the velocity along the channel 46, y is the dimension perpendicular to the channel 46. The shear velocity gradient, $dV_x/dy$, is far greater in the impingement zone than downstream.

The shear force on the sheet 44 depends weakly on the incident angle and distance of paper from jet plate 48, and is approximately proportional to the pressure drop across the airjet 42, as is represented in the graph of FIG. 4. Plenum pressure, as will be described below, is generally higher than the pressure across the jet 42 for the valve embodiment described. In an alternate embodiment, the plenum pressure can be of any suitable magnitude relative to the pressure across the jet 42. In one embodiment, the magnitude of the lateral force is typically 0.1 mN per jet.

Figure 5:
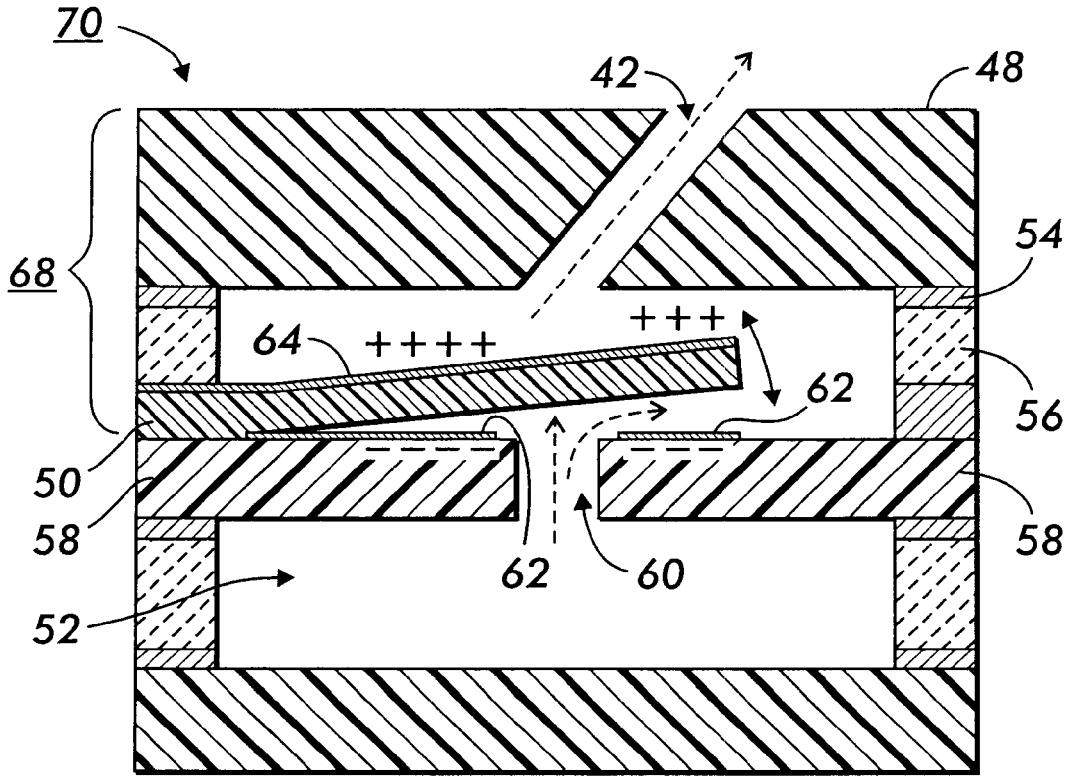
FIG. 5 is a cross-sectional view of one embodiment of an electrostatic flap valve incorporating features of the present invention.

The flow of air through an airjet 42 can generally be modulated by a valve mechanism 70 as shown in FIG. 5. In one embodiment, the valve mechanism 70 can comprise a plenum 52, an electrostatic flap valve 50, and an airjet 42. In an alternate embodiment, the valve mechanism 70 can include any suitable valve mechanism and structure adapted to control the flow of air to the jet 42. Although the embodiments of the present invention described herein are discussed in terms of "air", "airjets" and "air flow", any suitable fluid can be used other than including "air".

The electrostatic flap valve 50 is generally capable of switching on and off jet flows that can provide several tenths of a milli-newton of shear force. The flap valve 50 generally includes an upper electrode 64 and a lower electrode 62, across which an electric potential can be applied. The flap valve 50 can comprise any suitable material such as for example, polyester. The electrode material 64 can comprise an electrically conducting material, such as for example, aluminum or copper. In one embodiment, the lower electrode 62 and upper electrode 64 are electrically connected to a common potential, such as for example, a ground potential. As shown in FIG. 5, in that embodiment, pressurized air in the plenum 52 blows through a valve orifice or via 60 and out of the airjet 42 if there is no voltage drop across the flap valve 50. When a voltage is applied between electrodes 62 and 64, the upper electrode 64 is. attracted to the lower electrode 62. The flap valve 50 closes and seals the valve orifice 60.

The fabrication of flap valve mechanism 70 can generally comprise fabricating a 2-sided or multilayer printed circuit board 58 ("PCB") by standard means with an array of 1.5 mm diameter holes. The holes act as vias both for connecting the lower and upper copper traces on the PCB 58 as well as for providing air to the valve 50 from the plenum 52 below the PCB 58. In one embodiment, a gasket plate 56 can be laminated to both sides of the PCB 58. The gasket plate 56 can comprise an acrylic plate 2 mm in thickness, with thin film adhesive layers. In alternate embodiments, the gasket plate 56 can comprise any suitable material, such as for example, FR4, ceramic or flex. The gasket plate 56 can be laser cut to pattern the gasket around the valve orifice 60. In one embodiment, a supporting layer 54 can be used to facilitate handling and dimensional stability of the thin film. The supporting layer 54 can comprise an aluminized, 6-micron thick polyester sheet laminated onto a 250 microns thick polyester layer, although other suitable supporting materials may be used. After laser cutting, the thin film is aligned and bonded to the bottom of the gasket plate 56. A jet plate 48 including the airjets 42, can be aligned and laminated to the gasket plate 56. In one embodiment, the jet plate 48 can be laser cut to form 1 mm diameter holes tilted at 45° and oriented in the four cardinal directions to form the airjets 42. In an alternate embodiment, the jet plate 48 can comprise a multiple layer structure with holes spatially shifted by a fraction of a hole diameter in each layer which are aligned and stacked to provide the tilted air jets 42. Each layer in the multilayer structure can be formed by drilling, die cutting or photolithography, for example. The upper valve assembly 68, including the gasket plate 56 and the jet plate 48, can be affixed to the PCB 58. In one embodiment where a polyester sheet is used as the supporting layer 54, the polyester sheet is removed from the polyester flap valve array and the upper valve assembly 68 is laminated to the PCB 58. In one embodiment, a 50 micron thick adhesive can be used that compresses against the flap valve 50 material and bridges to the PCB 58.

In order to manipulate a flap valve 50 in an array of valves on the board 40, a common voltage is applied to the top electrode 64 of all flap valves 50 and the bottom electrodes 62 of each flap valve 50 are addressed individually. The electrostatic forces must be satisfactory to overcome the aerodynamic forces associated with flows necessary to adequately accelerate the object 44.

Figure 6:
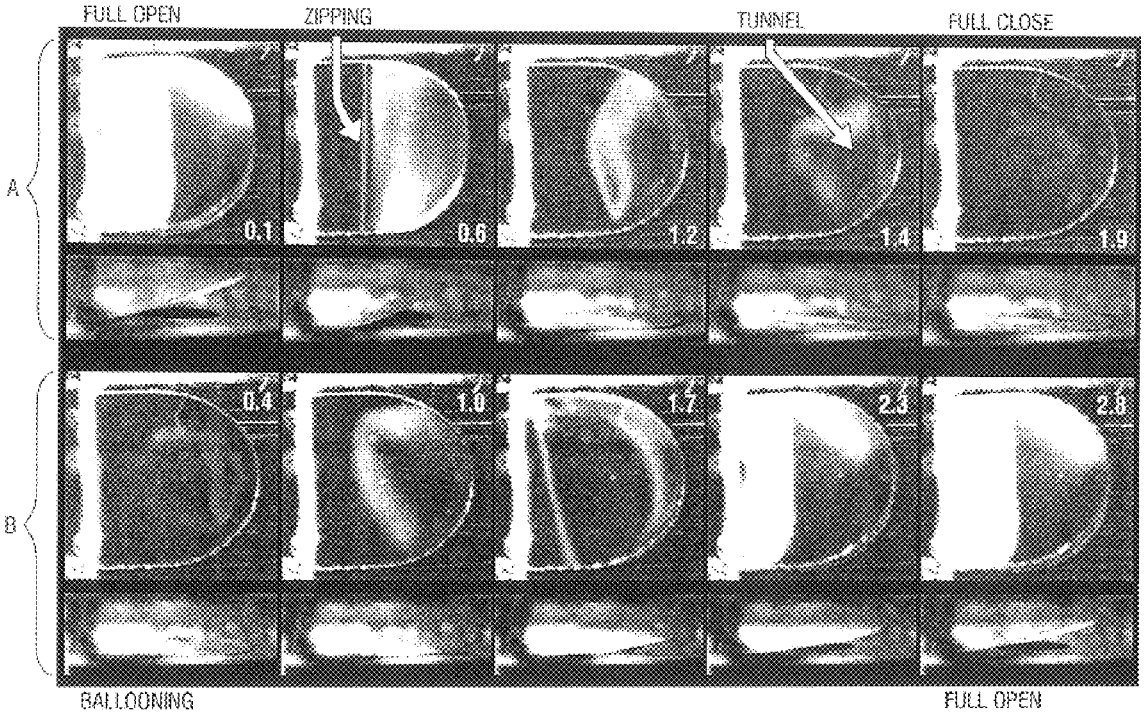
FIG. 6 is a pictorial representation of one embodiment of a flap valve configuration incorporating features of the present invention stroboscopically observed from above and from the side.

FIG. 6 shows a flap valve 50 being optically strobed at variable delays after the valve voltage is raised or lowered. The images obtained on video camera through a microscope show the stages of valve opening and closing seen from above (upper frames) and from a side (lower frames). The figures in the upper row A show selected frames for a flap valve 50 opening and lower row B shows a sequence while the flap valve 50 is closing. The plenum pressure in the valve mechanism 70 for the embodiment shown was 0.5 kPa (1/200 of an atmosphere) above atmosphere, the closing voltage was 300 V, and the opening voltage was 0 V. The flow through the opening valve under these conditions was 0.02 L/s.1. In the closing sequence the flap valve 50 first zips rapidly up to the orifice 60 then slows where the curvature increases as the flap valve 50 starts to close off the flow through the orifice 60. As the flap valve 50 approaches closure a "tunnel" is formed in the last one or more milliseconds before complete sealing. The closing time is taken to be the time when complete sealing occurred. On opening, the center of the flap valve 50 balloons up and the effective area of the aperture increases until the declining electrostatic force of the remaining flap can no longer withstand the increasing pneumatic force. After release, the flap valve 50 quickly rises to about half height then drifts more slowly to a larger height. The higher the pressure the faster the flap valve 50 is blown open. Similarly for high pressures and flows, the flap curvature is increased, the electrostatic forces are decreased, and the flap valve 50 takes longer to zip shut. Beyond about 1 kPa, under the conditions used here the flap valve 50 no longer can close. By changing gasket shape, valve orifice diameter, etc., closing pressure drops can be increased to several kPa.

Generally, the pressure is dropped across the flap valve 50 and airjet 42 in series. The impedance of a 4 mm long, 1 mm diameter jet 42 is very nearly equal to that of a 1 mm diameter aperture. The flow through an aperture at these small pressure drops is proportional to the square root of the pressure drop. The impedance, $\Delta P/F$, where F is the mass flow under the pressure gradient $\Delta P$, is thus not a constant. Series impedances add in quadrature. For an inlet aperture with area $A_i$ and outlet aperture with area $A_o$, in series, the pressure at the midpoint, i.e. in the gasket volume, rapidly equilibrates to $P=P_o+\Delta P_i/(r^2+1)$, where r is the ratio $A_o,/A_i$ and $\Delta P_i-P_o$ is the pressure drop from plenum 52 to jet exhaust. This is useful in determining the behavior of a flap valve 50 in conjunction with a particular diameter jet 42.

Figure 7:
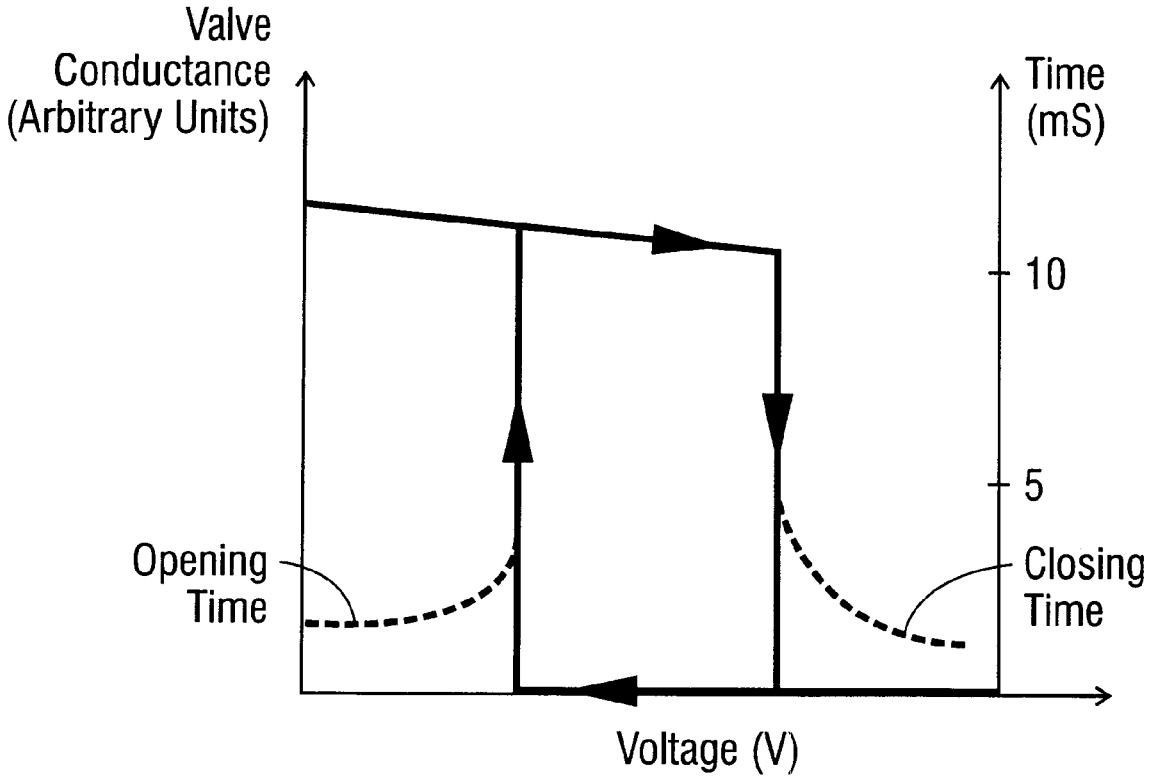
FIG. 7 is a graphical representation of valve conductance versus valve voltage for one embodiment of a flap valve configuration incorporating features of the present invention.

FIG. 7 is a schematic drawing of the hysteretic behavior of one embodiment of the present invention showing the steady state valve conductance as a function of valve voltage for a plenum pressure of 0.5 kPa. At zero volts the compliant flap valve 50 is blown open into a stable, inflected curve. For applied voltages less than 220 V the flap valve 50 zips up to the orifice 60 and stops. For voltages higher than 220 V the flap valve 50 zips to closure with the total elapsed time to completion decreasing with increasing voltage. Similarly, dropping the voltage to greater than 120 V does not allow the flap valve 50 to open because the electrostatic force is much greater when the flap valve 50 is shut than when it is open because of the finite curvature in the latter case. Thus, the voltage must be increased for an open flap valve 50 to overcome this barrier resulting in a hysteretic behavior.

Below 120 V the flap valve 50 is opened by the held-off pressure with times as shown in FIG. 7. Thus, the flexible electrostatic valves described here can be seen to have large stroke but have a region of sufficiently low curvature so that the gap between electrodes is small enough to provide electric fields strong enough to zip the membrane along. FIG. 7 also plots the opening times at low voltages and the closing times at high voltages. As shown, the higher the voltage the faster the flap valve 50 snaps shut, and the lower the voltage the faster the flap valve 50 pops open.

Another method used to characterize valve response, a method that is more functionally relevant, utilizes a silicon membrane pressure sensor, stripped of its packaging. The sensor is positioned at the impingement zone of a jet 42. The time dependence of the stagnation pressure of the jet, and therefore the time dependence of the flow in the channel, is determined from the response of the sensor. The measured flow generally follows the driving pulse except that both turn-on and turn-off have approximately a 1 ms delay and have <1 ms rise and fall time. There is a seeming discrepancy between the flow response times and the stroboscopic measurements of flap transition times, for both closing and opening the flow transitions occur more quickly. The difference arises predominantly from the variation in flow impedance of the valve when the flap valve 50 is near closure. The impedance of the flap valve 50 when the flap is near the lower electrode 62 increases strongly as the gap decreases. The impedance of the "tunnel" feature is much higher than that of the open valve. Therefore, the time to full visual closure overestimates the time of significant flow. Similarly, the impedance of the valve is limited by the impedance of the jet 42 when the flap valve 50 is well above the electrode 62. Therefore, when the flap valve 50 rises beyond a height of about d/4, where d is the diameter of the valve orifice 60, the flow is saturated. So again the stroboscopic estimate exceeds the flow response time. Another characteristic feature of the flow response is the approximately 1 millisecond delay between voltage drive and flow response. This is a convolution of the flap response time and the time constant for pressurizing and de-pressurizing the gasket volume, estimated to be 1–2 millisecond. Lifetime tests were run on an array of 120 valves by driving the valves in parallel with a 10 millisecond repetition time. Driving was terminated after 400 million repetitions with no valve failures and negligible charge injection-induced voltage shifts. The flap valves 50 are thus shown to be very reliable, most likely because the small curvatures of the flaps lead to negligible plastic deformation of the polyester or aluminum. Furthermore, having the aluminum above the plastic minimizes abrasion of both the aluminum and copper.

Figure 8:
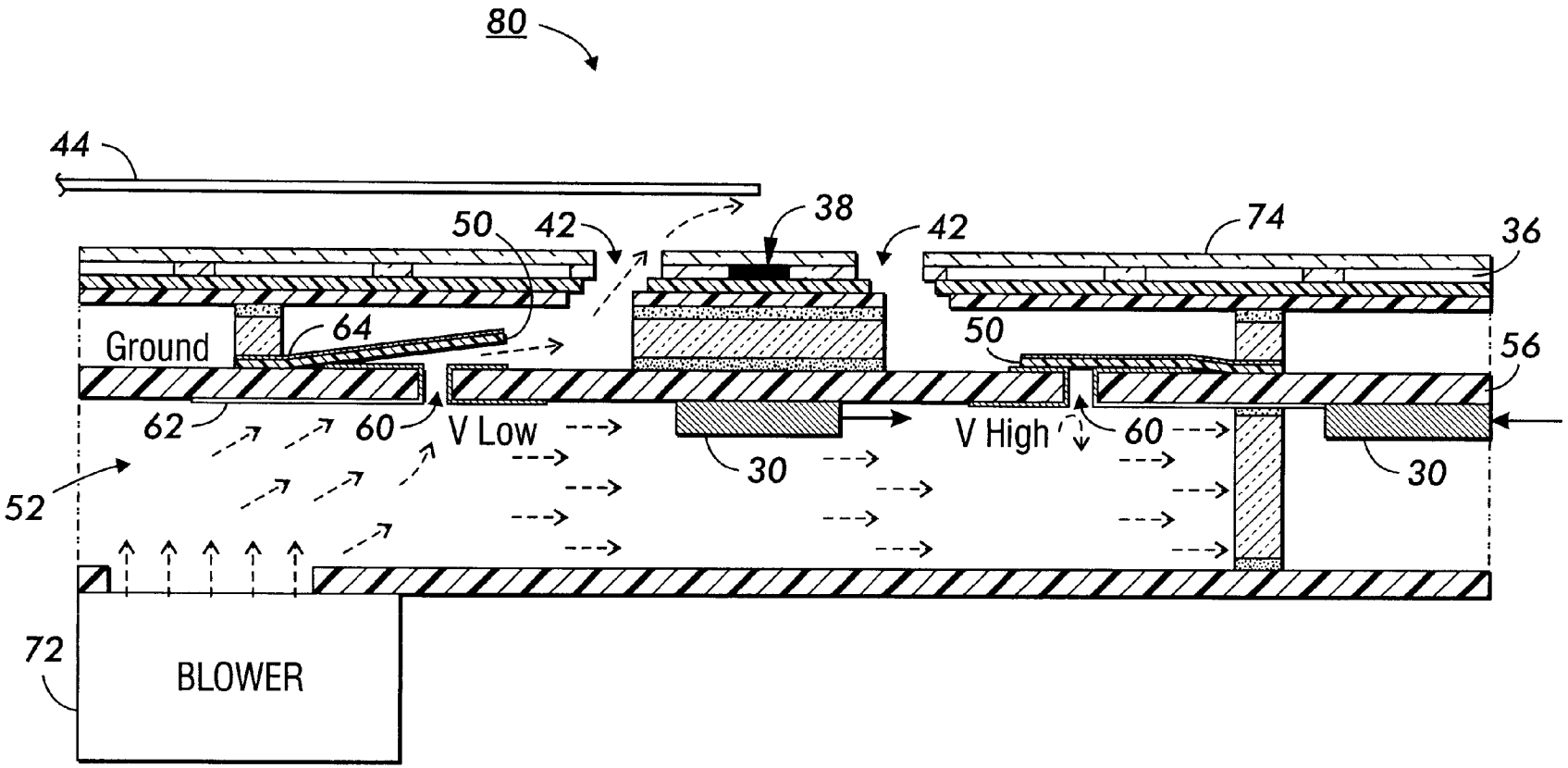
FIG. 8 is a side elevational view of a section of one embodiment of single side air table incorporating features of the present invention.
Figure 9:
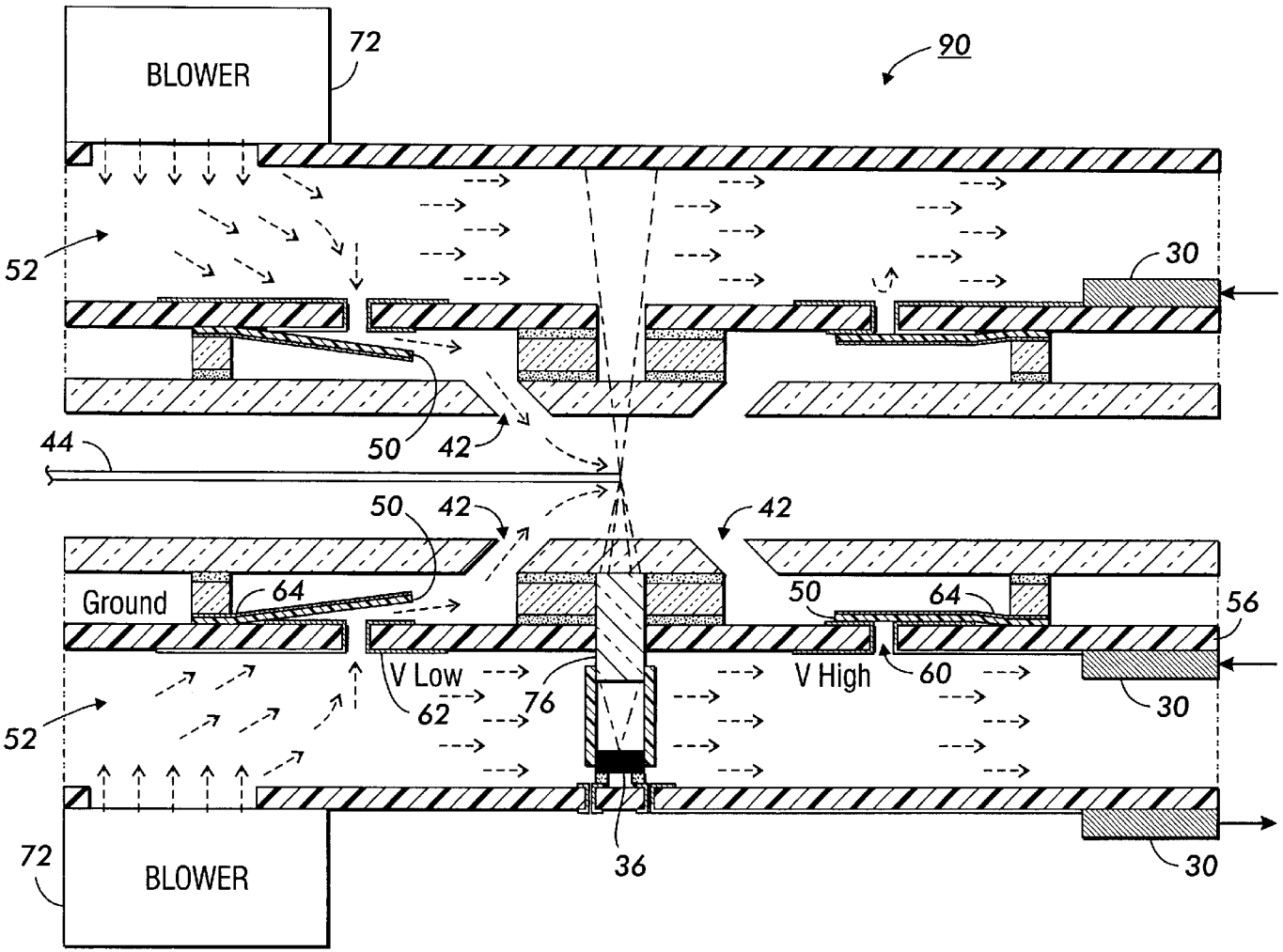
FIG. 9 is a side elevational view of a section of one embodiment of a two-side air channel incorporating features of the present invention.

To enable controlled manipulation of the object 44, the position of the object 44 must be sensed. As shown in FIG. 2, the air jet member assembly 12 may also include a sensor board 36. Generally, the sensor board 36 comprises an array of sensors 38 that are adapted to detect the position of the object 44 in two or more dimensions. In one embodiment, the sensor board 36 can comprise an array of linear CMOS sensor bars 38, having for example, an internal pixel pitch of 64 microns, to detect edge positions of the object 44 in two dimensions. In an alternate embodiment, any suitable means to detect a position of the object may be used, such as for example, a distributed optical sensor on the same PCB containing the actuators and computational electronics or an amorphous silicon or organic sensor array. In one embodiment, the levitated object is illuminated, either in transmission or reflection, and the contrast between the light levels with the object 44 absent and present are detected optically as edge transitions. For example, as shown in FIG. 9, Lambertian illumination from above casts a shadow of the object 44 which is imaged by a SelFoc™ array 76 onto the CMOS sensor 38. In one embodiment, a collimator 74 may overlay the sensor array 36 as shown in FIG. 8. All 1280 gray level pixels of all sensors are latched simultaneously and then clocked out every millisecond and binarized using a processor-set threshold. As shown in FIG. 2, a field programmable gate array (FPGA) 26 can be used to filter the outputs into acceptable edge transitions. The transitions can be passed to a digital signal processor (DSP) 18 to infer the position and rotation state of the object 44. In one embodiment, the desired position and orientation for the object 44 can be entered into the DSP 18 from a canned trajectory or from a three degree of freedom joystick 20 as shown in FIG. 2. Alternately, any suitable positioning device can be used to enter a desired position and trajectory of the object 42. The DSP 18 compares the sensed state of the object as determined by the sensor array 36 with the desired state as determined by the joystick 20, and generates the forces and torques required to null the differences. The DSP 18 is generally adapted to convert the transitions into a spatial map of edge crossings, and can generate a rectangle, a shape or multiple shapes which best fit through those transitions. A force allocation algorithm can then be used to determine which valves 50 should be opened and closed to best approximate the desired forces and torques. The commands can then be sent to another FPGA 26 which is adapted to drive the high voltage arrays 30 to enable the valve 50 transitions. In one embodiment, the control loop is pipelined with the sensing so that the entire feedback looping occurs within approximately one millisecond.

In the embodiment shown, control in the system 10 is centralized. Alternate embodiments may utilize distributed computation and control. The algorithm, operating with an approximately 25 Hz closed loop bandwidth, is a simple first order lead controller which can use history to disambiguate nearly equivalent fits of rectangles to the set of edge locations. Position is generally held to approximately 25 microns for statically positioned levitated objects, and tracking accuracy is approximately 75 microns for rapidly moving trajectories (such as circles and steps). Although the present invention is described in terms of moving an object, it should be understood that the controller can also be used to hold a relatively stationary position of the object 44. Generally, the joystick 20 is used to input a command signal to the controller corresponding to a desired direction of movement of the object 44. The joystick 20 may also be adapted to input a desired velocity for the object 44. In alternate embodiments, the joystick 20 can provide any suitable commands to the system 10. In one embodiment, the command signal may include a command to hold a position of the object 44, in which case the object 44 can be levitated in a relatively stationary position.

Figure 10:
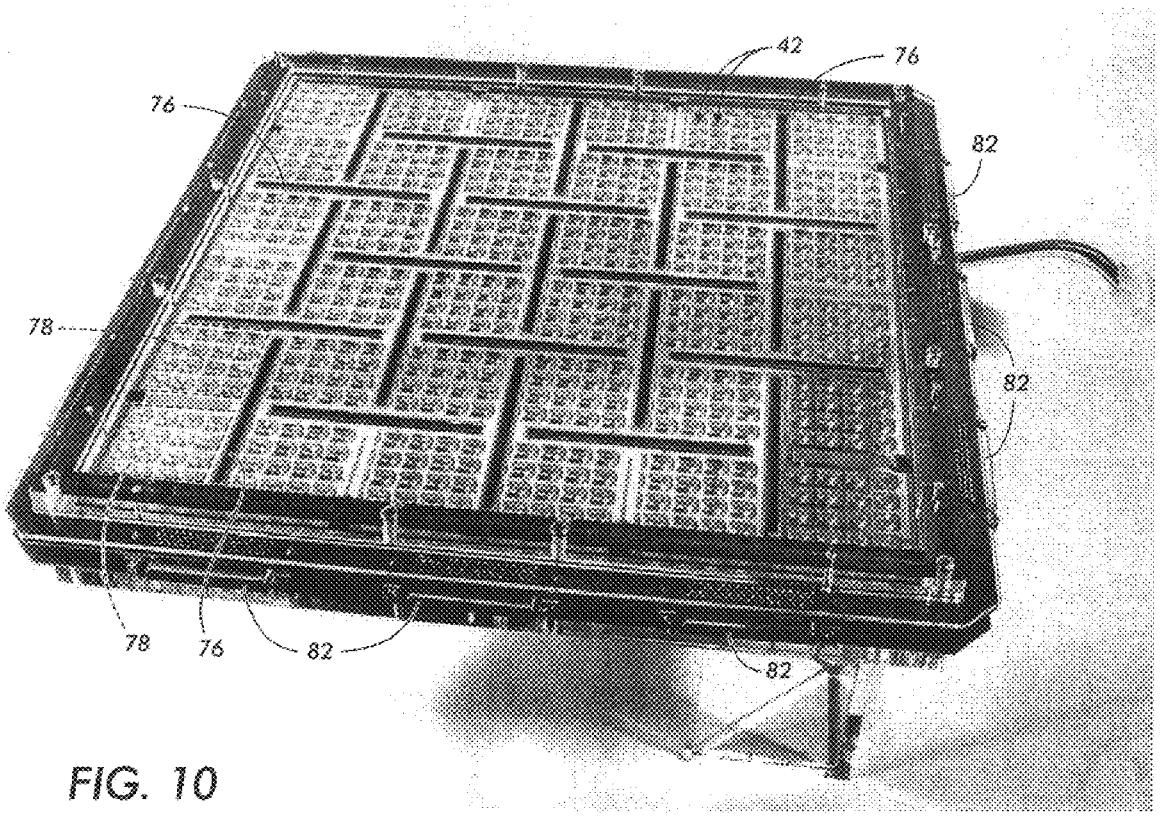
FIG. 10 is an elevational view of one embodiment of an airjet module incorporating features of the present invention.
Figure 11:
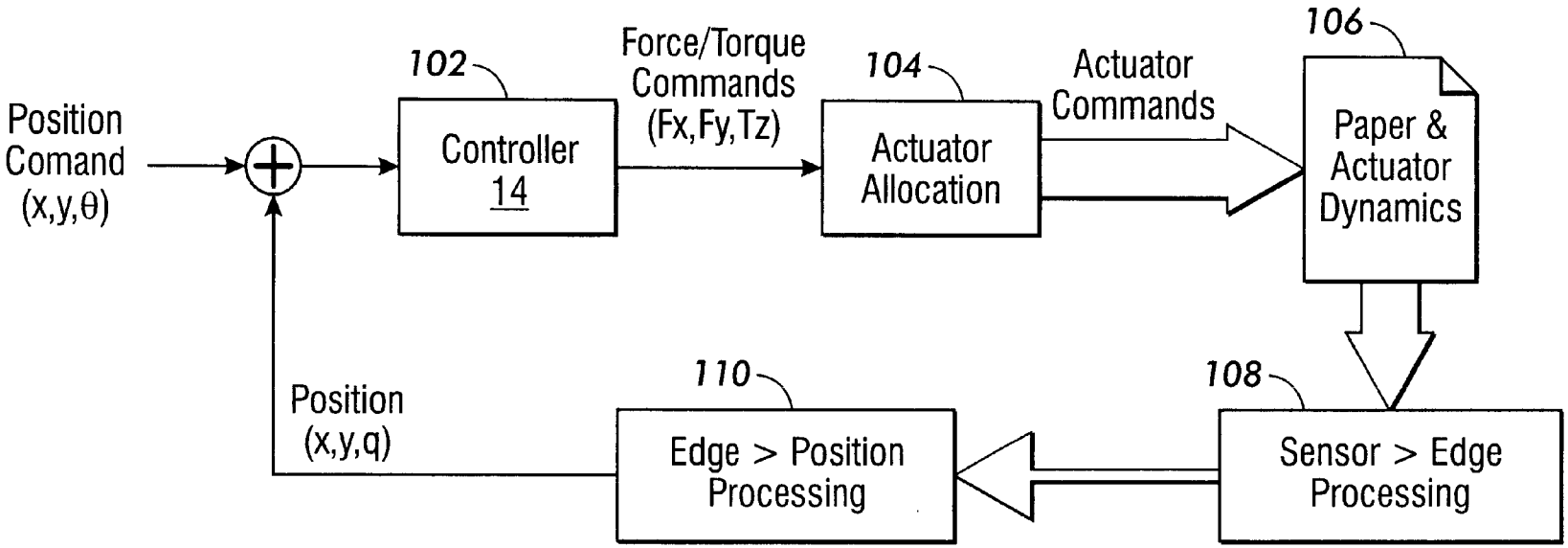
FIG. 11 is a flowchart of a control architecture for one embodiment of a system incorporating features of the present invention.

A control architecture flowchart for one embodiment of the present invention is shown in FIG. 10. Force and torque commands (Fx, Fy, and Tz are fed through the controller 14 in order to allocate the valve 50 actuators as indicated in blocks 102 and 104. The actuator allocation generally includes control commands for each of the 576 valves in a single sided embodiment of the air table described above. In an alternate embodiment, an air table could include any suitable number of valves. Generally, the force and torque commands depend from a position command(s) (x,y,θ) from the position control device 20 or devices, and the detected position(s) (x,y,q) of the object or objects. The actuator commands are processed through the paper and actuator dynamics as indicated in block 106. The detection of the object 44 can be processed through sensor-edge processing as indicated in block 108, which can then be used to determine the position in terms of coordinates (x,y,q) of the object as indicated in block 110. The control loop depicted in FIG. 11 allows for accurate control and movement of an object 44 over a board 12.

The system 10 can generally be operated either as a single sided air table 80 as shown in FIG. 8 or as a 2-sided air channel 90 as shown in FIG. 9. In an alternate embodiment, the system 10 may be operated with any suitable number of sides, such as for example, a tunnel. As shown in FIGS. 8 & 9, the system 10 can include a blower 72 to supply air to the plenum 52. The system 10 can include any suitable number of plenums 52 and blowers 72. The system 10 can also include high voltage drivers 74. Generally, the 2-sided system 90 has better performance characteristics due to the increased actuation authority and the stablilization from a double sided air bearing created by the air flow from two jets 42 impinging on the object 44. The 2-sided air bearing effectively stiffens the object and maintains the sheet at a fixed height (approximately 2 mm above the jet plate 48) independent of plenum pressure as long as both top and bottom plena 52 are at the same pressures.

FIG. 10 shows one embodiment of a 12 inch×12 inch 30.48 cm × 30.48 cm airjet object mover module 12 or board game. Although this embodiment comprises arrays of square modules, and suitable size or shape of array can be used, such as for example circular arrays as shown in FIG. 12. In the example shown in FIG. 10, each actuation PCB 58 consists of 576 valves 50 and jets 42; 144 (or one per square inch) point in each of the four cardinal directions. The jets 42 are interleaved with the sensor bars 38. Sixteen element arrays 78 comprise flap valves 50 and associated jets 42. The black bars are SelFoc™ arrays 76. By invoking an image of valve openings arbitrary force fields can be applied to the levitated objects 44. Object motions with three degrees of freedom (x, y, θ) can be controlled, and gray levels of force can be asserted by changing the number of jets 42 or the time of actuation of jets 42.

Connectors 82 are provided for coupling to the controller 12 and other related components or devices. In one embodiment, an airjet module 12 is adapted to be connected to one or more other airjet modules 12. In this manner, a series of airjet modules 12 can be connected in order to provide a larger platform or a pathway along which an object 44 can be moved.

One feature of the system 10 is that due to the individual airjet 42 control, pieces of paper or other objects 44 can be moved arbitrarily in a two-dimensional plane. Although the object 44 is described herein as being flat, any object 44 that can be moved, roller or levitated by an airjet 42 or series of airjets, can be used. In one embodiment, a board game application of the system 10 can have one or more players competing to move/block playing pieces 44 using one or more position control devices 20, such as one or more joysticks. For example, an airjet board game incorporating features of the present invention could include two 3-degree of freedom joysticks 20 to allow two or more users to move one or more objects 44 past each other toward some goals. In another embodiment, the airjet board game could include an individual user playing against a computer.

The system 10 allows for maneuverability of the playing pieces as well as programmability of the field of play. Games may include for example, soccer, hockey, and obstacle races. Programmable fields of play could include for example, hills and tunnels, where the physical "terrain" of the playing field or board 12 could be modified by the computer.

In another embodiment, the system 10 could be adapted to move sheets of paper along a path or sort tiles into desired patterns.

The architecture described above provides for the control of thousands of actuators and sensors. The system described above has a largely centralized control architecture. The scalability of control electronics and algorithms for assemblies of numerous independent agents, particularly for human-scaled systems demands distributed computation and control. Systems tightly integrating many actuators, sensors, computational nodes and communication, can be called "smart matter".

In designing smart matter systems the boundaries between the digital and analog worlds are blurred. An example of a smart matter approach to achieve a scalable control design is an analog "market wire" developed to perform the force allocation tasks. In one embodiment of the airjet module 12, each set of four actuators, pointing in four different directions, is a force agent. One or more sensors 38 can be associated with each force agent. An analog circuit and/or micro-controller can be associated with each agent. Agents can thus sense and act locally, but coherent, larger scale actions are required. PCBs can have many layers of metal for little extra expense. An agent, such as a controller 14, can request more of a commodity, say force in the x direction, by sourcing current onto such a plane, a market wire, basically a capacitor. The voltage (the "price" of the x-force) rises. Each agent has vias connecting to the market wire(s). Producer agents, the airjet foursomes, consider supplying the x-force. First the local sensor 38 looks up at the object 44. If it is there it makes sense to participate. Should it turn on? Locally it has a "marginal utility function" which says, in effect, if the voltage is above a certain threshold, turn the x-valve on. Then sink current from the x-force market wire, dropping the "price". Another agent, perhaps far away, but also under the sheet, asynchronously decides that the price has now dropped below its threshold and decides not to turn on. The desired force is thus provided almost instantaneously. The mechanism is easily scalable. It is essentially independent of the number of agents on a board. If another board is added to the system, the market wires are joined and no change in programming is needed.

The airjet mover is an exemplar of a smart matter system. The airjets provide a low-mass system for moving objects in three degrees of freedom without making physical contact with the objects.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An air jet device comprising:

an air jet conduiting member having a plurality of air jet outlets;

a user-directed controller adapted to selectively control at least partially, flow of air out of individual air jet outlets in order to move at least one object located in an air flow path of the outlet in any user desired direction; and at least one user-directed positioning device coupled to the controller, the user-directed positioning device adapted to provide at least one control input to the control corresponding to the user-desired direction of movement of the object.

2. The air jet device of claim 1 wherein the air jet conduiting member comprises:

an array of electrostatic flap valves, each flap valve associated with a corresponding air jet outlet, wherein the flow of air through each air jet outlet is selectively controlled at least partially by the associated electrostatic flap valve; and an array of sensors adapted to detect a position of the object.

3. The air jet device of claim 2 wherein the array of sensors comprises an optical sensor array.

4. The air jet device of claim 2 wherein the array of sensors comprises an array of linear CMOS sensor bars.

5. The air jet device of claim 1 wherein each air jet outlet is adapted to provide an air flow of several tenths of a millinewton of shear force.

6. The air jet device of claim 1 wherein the object is supported and accelerated over the member without physical contact with the member.

7. The air jet device of claim 1 wherein the member comprises a two-sided air channel.

8. The air jet device of claim 1 wherein the member comprises a single sided air table.

9. The air jet device of claim 1 wherein the controller further includes at least one position control device, the position control device being adapted to provide a control input to the controller, the control input corresponding at least partially to the desired direction of movement of the object.

10. The air jet device of claim 9 wherein the position control device is further adapted to provide three degrees of freedom of the object parallel to the member.

11. The air jet device of claim 1 wherein the device comprises an air jet board game adapted to be played by one or more users and wherein points are scored by moving the object in the desired direction past a goal.

12. The air jet device of claim 1 wherein the user-directed positioning device is adapted to provide control inputs corresponding to 3-degrees of freedom.

13. The air jet device of claim 1 further comprising a, second user-directed positioning device adapted to control the movement of the object along the air flow path in any desired position.

14. An air jet object mover device comprising:

an array of air jets;

an array of object sensors; and a first controller and a second controller coupled to the array of air jets and the array of object sensors, the first and second controllers being adapted to selectively control a movement of one or more objects over the array of air jets by selectively activating one or more of the air jets individually based upon a detected position of the object by the object sensors and a desired direction of movement of the object, wherein the first controller and the second controller are 3-degree of freedom joysticks.

15. The device of claim 14 wherein the array of air jets comprises:

a printed circuit board, the printed circuit board including a plurality of vias to allow air to flow from a plenum on one side of the printed circuit board to an associated electrostatic flap valve on an other side of the printed circuit board; and an air jet plate mounted on the other side of the printed circuit board, the air jet plate including a plurality of air jets, each air jet associated with one of the electrostatic flap valves and adapted to allow the air to flow from the flap valve through the air jet.

16. The device of claim 14, wherein the array of sensors is adapted to detect an edge position of the object in at least two dimensions.

17. The device of claim 14, wherein each flap valve is adapted to be connected to an electric potential in order to manipulate the flap valve between an open and closed position.

18. The device of claim 14, wherein the first controller and the second controller are each adapted to compare a sensed position of the object with a desired position of the object and selectively energize the air jets in order to generate a force and a torque to null the differences.

19. The device of claim 18, wherein the first controller and the second controller uses a force allocation algorithm to determine the flap valves to be opened and closed to best approximate the force and the torque to null the differences.

20. The air jet object mover of claim 14, wherein the object mover comprises a board game and wherein points are scored by moving the object over the array of air jets to a desired section of the board game.

21. A method of controlling the movement of at least one object in an air jet board game comprising the steps of:

detecting a position of the object;

moving the object in a desired direction by one or more air jets in the board, the step of moving comprising each air jet being selectively energized based upon the detected position of the object and a respective control input corresponding to a desired direction and a desired velocity for the object and scoring points in the game by moving the object past a goal area on the board.

22. The method of claim 21, wherein the step of moving the object further comprises the step of using a position control device to provide the control input in order to selectively energize the air jets.

23. The method of claim 21, wherein the step of detecting a position of the object comprises the step of sensing an edge position of the object in at least two dimensions.

24. The method of claim 21, wherein the air jet board device comprises an air jet board game and the method further comprises the step of scoring points in the game by moving the object past a goal area on the board.

25. The method of claim 21 wherein the user-directed positioning device is adapted to allow a user to control the object in 3-degrees of freedom.

* * * * *